US011306372B2

(12) United States Patent
Wang et al.

(10) Patent No.: US 11,306,372 B2
(45) **Date of Patent: *Apr. 19, 2022**

(54) COBALT-BASED ALLOY POWDER, COBALT-BASED ALLOY SINTERED BODY, AND METHOD FOR PRODUCING COBALT-BASED ALLOY SINTERED BODY

(71) Applicant: MITSUBISHI POWER, LTD., Yokohama (JP)

(72) Inventors: Yuting Wang, Yokohama (JP); Shinya Imano, Yokohama (JP)

(73) Assignee: MITSUBISHI POWER, LTD., Yokohama (JP)

( * ) Notice: Subject to any disclaimer, the term of this patent is extended or adjusted under 35 U.S.C. 154(b) by 54 days.

This patent is subject to a terminal disclaimer.

(21) Appl. No.: 16/640,207

(22) PCT Filed: Dec. 26, 2019

(86) PCT No.: PCT/JP2019/051097

§ 371 (c)(1),
(2) Date: Feb. 19, 2020

(87) PCT Pub. No.: WO2020/179207

PCT Pub. Date: Sep. 10, 2020

(65) Prior Publication Data

US 2021/0140016 A1 May 13, 2021

(30) Foreign Application Priority Data

Mar. 7, 2019 (WO) ..... PCT/JP2019/009207

(51) Int. Cl.
*B22F 1/00* (2022.01)
*C22C 19/07* (2006.01)
(Continued)

(52) U.S. Cl.
CPC ..... *C22C 19/07* (2013.01); *B22F 1/05* (2022.01); *B22F 9/04* (2013.01); *B22F 9/082* (2013.01);
(Continued)

(58) Field of Classification Search
None
See application file for complete search history.

(56) References Cited

U.S. PATENT DOCUMENTS 3,937,628 A 2/1976 Watanabe et al.
4,437,913 A 3/1984 Fukui et al.
(Continued)

FOREIGN PATENT DOCUMENTS

CA 3061851 A1 11/2019
CA 3061851 A1 6/2020
(Continued)

OTHER PUBLICATIONS

Yuan, C., et al., "Effect of Nitrogen on Microstructure and Properties of a Cast Cobalt-Base Superalloy," Advanced Materials Research, vol. 278, 2011, pp. 472-478.
(Continued)

*Primary Examiner* — Seth Dumbris
(74) *Attorney, Agent, or Firm* — Volpe Koenig

(57) ABSTRACT

A Co based alloy powder includes between 0.08% and 0.25% mass of carbon, 0.1% mass or less of boron, between 10% and 30% mass of chromium, 5% mass or less of iron, and 30% mass or less of nickel; the iron and the nickel in a total amount of 30% mass or less; includes at least one of tungsten and molybdenum in a total amount of between 5% and 12% mass; includes at least one of titanium, zirconium, niobium, tantalum, hafnium, and vanadium in a total amount of between 0.5% mass and 2% mass; includes 0.5% mass or less of silicon, 0.5% mass or less of manganese, and between
(Continued)

0.003% and 0.04% mass of nitrogen; and includes cobalt and impurities as the balance of the powder. Crystal grains included in the cobalt-based alloy powder have segregated cells; the cells have an average size of between 0.15 μm and 4 μm.

14 Claims, 4 Drawing Sheets

(51) Int. Cl.
*B22F 1/05* (2022.01)
*B22F 9/04* (2006.01)
*B22F 9/08* (2006.01)

(52) U.S. Cl.
CPC ..... *B22F 2301/15* (2013.01); *B22F 2304/10* (2013.01); *Y10T 428/12014* (2015.01)

(56) References Cited

U.S. PATENT DOCUMENTS

| | | | | |
|---|---|---|---|---|
| 4,789,412 | A | 12/1988 | Nakamura et al. | |
| 5,403,547 | A | 4/1995 | Smith et al. | |
| 5,640,667 | A | 6/1997 | Freitag et al. | |
| 7,067,201 | B2 | 6/2006 | Ellis et al. | |
| 7,165,325 | B2 | 1/2007 | Imano et al. | |
| 9,346,101 | B2 * | 5/2016 | Zheng | C22C 19/005 |
| 10,632,535 | B2 | 4/2020 | Imano et al. | |
| 2004/0033158 | A1 * | 2/2004 | Chiba | C22C 19/055 420/585 |
| 2004/0050114 | A1 | 3/2004 | Berthod et al. | |
| 2008/0185078 | A1 * | 8/2008 | Ishida | C22F 1/10 148/674 |
| 2010/0296962 | A1 | 11/2010 | Hasselqvist et al. | |
| 2012/0279351 | A1 | 11/2012 | Gu et al. | |
| 2013/0206287 | A1 | 8/2013 | Sato et al. | |
| 2013/0263977 | A1 | 10/2013 | Rickenbacher et al. | |
| 2014/0295087 | A1 | 10/2014 | Rickenbacher et al. | |
| 2015/0068629 | A1 | 3/2015 | Kottilingam et al. | |
| 2016/0151860 | A1 | 6/2016 | Engeli et al. | |
| 2016/0175934 | A1 | 6/2016 | Lacy et al. | |
| 2016/0200045 | A1 | 7/2016 | Hopkins et al. | |
| 2016/0258298 | A1 | 9/2016 | Channel et al. | |
| 2017/0241287 | A1 | 8/2017 | Nakamura et al. | |
| 2017/0291220 | A1 | 10/2017 | Nakamura et al. | |
| 2018/0264547 | A1 | 9/2018 | Tamura et al. | |
| 2019/0076926 | A1 | 3/2019 | Imano et al. | |
| 2019/0226058 | A1 | 7/2019 | Fujieda et al. | |
| 2020/0016658 | A1 | 1/2020 | Imano et al. | |
| 2020/0016659 | A1 | 1/2020 | Imano et al. | |
| 2020/0094325 | A1 | 3/2020 | Taneike et al. | |
| 2021/0332460 | A1 | 10/2021 | Wang et al. | |

FOREIGN PATENT DOCUMENTS

| | | | |
|---|---|---|---|
| CN | 1053094 | A | 7/1991 |
| CN | 101528959 | A | 9/2009 |
| CN | 103069028 | A | 4/2013 |
| CN | 107513642 | A | 12/2017 |
| EP | 1378579 | B1 | 11/2005 |
| JP | 55-076038 | A2 | 6/1980 |
| JP | 58-042741 | A2 | 3/1983 |
| JP | 58-117848 | A2 | 7/1983 |
| JP | 61-243143 | A | 10/1986 |
| JP | 63-011638 | A | 1/1988 |
| JP | 63-011638 | A2 | 1/1988 |
| JP | 06-287667 | A | 10/1994 |
| JP | 07-179967 | A | 7/1995 |
| JP | 09-157780 | A | 6/1997 |
| JP | 2002-249838 | A | 9/2002 |
| JP | 2006-089796 | A | 4/2006 |
| JP | 2009-228024 | A | 10/2009 |
| JP | 5576038 | B2 | 8/2014 |
| JP | 2015-072007 | A | 4/2015 |
| JP | 2016-029217 | A | 3/2016 |
| JP | 2016-102229 | A | 6/2016 |
| JP | 2016-102257 | A | 6/2016 |
| JP | 2016-535169 | A | 11/2016 |
| JP | 2017-145483 | A | 8/2017 |
| JP | 2017-186620 | A | 10/2017 |
| JP | 2019-049022 | A | 3/2019 |
| JP | 06-509290 | B2 | 5/2019 |
| JP | 2019-173175 | A | 10/2019 |
| JP | 2020-143379 | A | 9/2020 |
| MX | 2015016373 | A | 5/2017 |
| WO | 1997/010368 | A1 | 3/1997 |
| WO | 2013/087515 | A1 | 6/2013 |
| WO | 2015073081 | A1 | 5/2015 |
| WO | 2018/181098 | A1 | 10/2018 |
| WO | 2019031577 | A1 | 2/2019 |
| WO | 2020/121367 | A1 | 6/2020 |
| WO | 2020121367 | A1 | 6/2020 |
| WO | 2020/179080 | A1 | 9/2020 |
| WO | 2020/179081 | A1 | 9/2020 |
| WO | 2020/179083 | A1 | 9/2020 |
| WO | 2020/179084 | A1 | 9/2020 |
| WO | 2020179085 | A1 | 9/2020 |
| WO | 2021033546 | A1 | 2/2021 |
| WO | 2021033547 | A1 | 2/2021 |
| WO | 2021131167 | A1 | 7/2021 |

OTHER PUBLICATIONS

Canadian Office Action dated Apr. 13, 2021 for Canadian Patent Application No. 3 061 851.
Sears, "Laser Additive Manufacturing for Improved Wear and Performance", Advances in Powder Metallurgy & Particulate Materials, Metal Powder Industries Federation, Princeton, NJ, US, vol. 8 (2009).
Holt et al., "Impurities and Trace Elements in Nickel-base Superalloys", International Metals Reviews, pp. 1-24, Mar. 1976.
Extended European Search Report dated Dec. 4, 2019 for the European Patent Application No. 19197441.9.
Extended European Search Report dated Dec. 4, 2019 for the European Patent Application No. 19197443.5.
Chinese Office Action dated Apr. 27, 2020 for the Chinese Patent Application No. 201811040282.2.
Extended European Search Report dated Nov. 9, 2020 for the European Patent Application No. 19813222.7.
Extended European Search Report dated Nov. 9, 2020 for the European Patent Application No. 19808959.1.
International Search Report dated Nov. 17, 2020 for International Application No. PCT/JP2020/033544.
U.S. Office Action dated Jan. 8, 2021 for U.S. Appl. No. 16/582,517.
Indian Office Action dated Mar. 1, 2021 for Indian Patent Application No. 201814033368.
Japanese Office Action dated Feb. 24, 2021 for Japanese Patent Application No. 2020-509122.
Japanese Office Action dated Feb. 24, 2021 for Japanese Patent Application No. 2020-509117.
Japanese Office Action dated Feb. 24, 2021 for Japanese Patent Application No. 2020-508062.
Australian Office Action dated Oct. 14, 2020 for Australian Patent Application No. 2018422117.
Extended European Search Report dated Nov. 30, 2020 for European Patent Application No. 19808671.2.
Yuan, C., et al., "Effect of Nitrogen on Microstructure and Properties of a Cast Cobalt-Base Superalloy," Advanced Materials Research, vol. 278, (2011).
International Search Report, PCT/JP2020/033546, dated Nov. 17, 2020, 3 pgs. (Japanese only).
Extended European Search Report issued in European Application No. 18192365.7, dated Nov. 8, 2018, 10 pages.
International Search Report issued in International Application No. PCT/JP2019/009205, dated Jun. 4, 2019, 5 pages. (English translation 2 pages).
International Search Report issued in International Application No. PCT/JP2019/009206, dated Jun. 4, 2019, 5 pages. (English translation 2 pages).

(56) References Cited

OTHER PUBLICATIONS

International Search Report issued in International Application No. PCT/JP2019/009208, dated Jun. 4, 2019, 5 pages. (English translation 2 pages).
International Search Report issued in International Application No. PCT/JP2019/009209, dated Jun. 4, 2019, 5 pages. (English translation 2 pages).
International Search Report issued in International Application No. PCT/JP2019/009210, dated Jun. 11, 2019, 3 pages. (English translation 1 page).
International Search Report, PCT/JP2020/033547, dated Nov. 11, 2020; 3 pgs.
Tan et al., "Carbide precipitation characteristics in additive manufacturing of Co—Cr—Mo alloy via selective electron beam melting." Scripta Materialia 143: 117-121 (2018).

* cited by examiner

COBALT-BASED ALLOY POWDER, COBALT-BASED ALLOY SINTERED BODY, AND METHOD FOR PRODUCING COBALT-BASED ALLOY SINTERED BODY

TECHNICAL FIELD

The present invention relates to a cobalt-based alloy powder, a cobalt-based alloy sintered body, and a method for producing a cobalt-based alloy sintered body.

BACKGROUND ART

Cobalt (Co) based alloy materials are, together with nickel (Ni) based alloy materials, typical heat-resistant alloy materials, and are called super alloys. These materials are widely used for high-temperature members of turbines (for example, gas turbines and steam turbines). Cobalt based alloy materials are higher in material costs than Ni based alloy materials, but are better in corrosion resistance and abrasion resistance and are more easily subjected to solute strengthening than the latter materials. Thus, the former materials have been used as turbine static blades and combustor members.

Regarding heat-resistant alloy materials, up to the present time, various improvements have been made in alloy composition and in producing process. On the basis of the improvements, regarding Ni based alloy materials, the strengthening thereof has been developed by the precipitation of their γ' phase (for example, their $Ni_3(Al, Ti)$ phase), and has been a main current. On the other hand, regarding cobalt-based alloy materials, there is not easily precipitated an intermetallic compound phase which contributes largely to an improvement of the materials in mechanical properties such as the γ' phase in the Ni based alloy materials. Thus, researches have been made about precipitation strengthening by a carbide phase.

For example, Patent Literature 1 (JP Sho 61-243143 A) discloses a Co based superplastic alloy characterized by precipitating carbide lumps and carbide grains each having a grain size of 0.5 to 10 μm into a base of a cobalt-based alloy which has a crystal grain size of 10 μm or less; and discloses that the cobalt-based alloy includes the following C: 0.15-1%, Cr: 15-40%, W and/or Mo: 3-15%, B: 1% or less, Ni: 0-20%, Nb: 0-1.0%, Zr: 0-1.0%, Ta: 0-1.0%, Ti: 0-3% and Al: 0-3%, and the balance of Co, all of the "%"s being each percent by weight. Patent Literature 1 states that a Co based superplastic alloy can be formed which shows super plasticity even in a low-temperature range (including, for example, 950° C.) to have an elongation of 70% or more, and can further be formed in complicatedly-shaped products by plastic working such as forging.

Patent Literature 2 (JP Hei 7-179967) discloses a cobalt-based alloy that is excellent in corrosion resistance, abrasion resistance and high-temperature strength, and includes Cr: 21-29%, Mo: 15-24%, B: 0.5-2%, Si: 0.1% or more and less than 0.5%, C: more than 1% and 20 or less, Fe: 20 or less, Ni: 20 or less, and the balance made substantially of Co, all of the "%"s being each percent by weight. Patent Literature 2 states that this Co based alloy has a composite microstructure in which a molybdenum boride and a chromium carbide are relatively finely dispersed in a quaternary alloy phase of Co, Cr, Mo and Si, and is good in corrosion resistance and abrasion resistance and high strength.

CITATION LIST

Patent Literatures

PTL 1: JP Sho 61-243143 A
PTL 2: JP Hei 7-179967 A

SUMMARY OF THE INVENTION

Technical Problem

Cobalt based alloy materials as described in Patent Literatures 1 and 2 would have higher mechanical properties than cobalt-based alloys before the development of the former alloys. However, it cannot be said that the former alloys do not have sufficient mechanical properties when compared with a precipitation strengthened Ni based alloy materials in recent years. However, if the Co based alloy materials can attain mechanical properties (such as a 100000-hour creep durable temperature of 875° C. or higher at 58 MPa, and a tensile proof stress of 500 MPa or more at room temperature) equivalent to or higher than those of γ' phase precipitation strengthened Ni based alloy materials, the Co based alloy materials can turn to materials suitable for turbine high-temperature members.

The present invention has been made in light of problems as described above; and an object thereof is to provide a Co based alloy powder, a Co based alloy sintered body, and a method for producing a Co based alloy sintered body that each can provide a Co based alloy material having mechanical properties equivalent to or higher than those of precipitation strengthened Ni based alloy materials.

Solution to Problem

An embodiment of the Co based alloy powder of the present invention for attaining the object is:

a cobalt-based alloy powder, including:

0.08 mass % or more and 0.25 mass % or less of carbon;

0.1 mass % or less of boron;

10 mass % or more and 30 mass % or less of chromium;

5 mass % or less of iron; and 30 mass % or less of nickel, including the iron and the nickel to be in a total amount of 30 mass % or less, including at least one selected from the group of tungsten and molybdenum to be in a total amount of 5 mass % or more and 12 mass % or less, including at least one selected from the group of titanium, zirconium, niobium, tantalum, hafnium, and vanadium to be in a total amount of 0.5 mass % or more and 2 mass % or less;

including:

0.5 mass % or less of silicon;

0.5 mass % or less of manganese; and 0.003 mass % or more and 0.04 mass % or less of nitrogen; and including cobalt and impurities as the balance of the powder, and crystal grains included in the cobalt-based alloy powder having segregated cells, and the segregated cells having an average size of 0.15 μm or more and 4 μm or less.

An embodiment of the Co based alloy sintered body of the present invention for attaining the object is:

a cobalt-based alloy sintered body, including:

0.08 mass % or more and 0.25 mass % or less of carbon;

0.1 mass % or less of boron;

10 mass % or more and 30 mass % or less of chromium;

5 mass % or less of iron; and 30 mass % or less of nickel, including the iron and the nickel to be in a total amount of 30 mass % or less, including at least one selected from the group of tungsten and molybdenum to be in a total amount of 5 mass % or more and 12 mass % or less, including at least one selected from the group of titanium, zirconium, niobium, tantalum, hafnium, and vanadium to be in a total amount of 0.5 mass % or more and 2 mass % or less;

including:

0.5 mass % or less of silicon;

0.5 mass % or less of manganese; and 0.04 mass % or more and 0.1 mass % or less of nitrogen; and including cobalt and impurities as the balance of the sintered body, and crystal grains included in the cobalt-based alloy sintered body having segregated cells, and the segregated cells having an average size of 0.15 μm or more and 4 μm or less.

An embodiment of the method, for producing a Co based alloy sintered body, of the present invention for attaining the object is a method for producing a cobalt-based alloy sintered body, including a raw-material mixing and melting step of mixing raw materials of a cobalt-based alloy powder having the abovementioned chemical composition with each other, and melting the raw materials to produce a molten metal, a molten-metal-pulverizing step of producing a quenched and solidified alloy powder from the molten metal, and a sintering step of sintering the quenched and solidified alloy powder; the cobalt-based alloy powder having the composition of the Co based alloy powder of the present invention.

Advantageous Effects of Invention

The present invention makes it possible to provide a Co based alloy powder, a Co based alloy sintered body, and a method for producing a Co based alloy sintered body that each can provide a Co based alloy material having mechanical properties equivalent to or higher than those of precipitation strengthened Ni based alloy materials.

DESCRIPTION OF EMBODIMENTS

[Basic Idea of the Present Invention]

Figure 1:
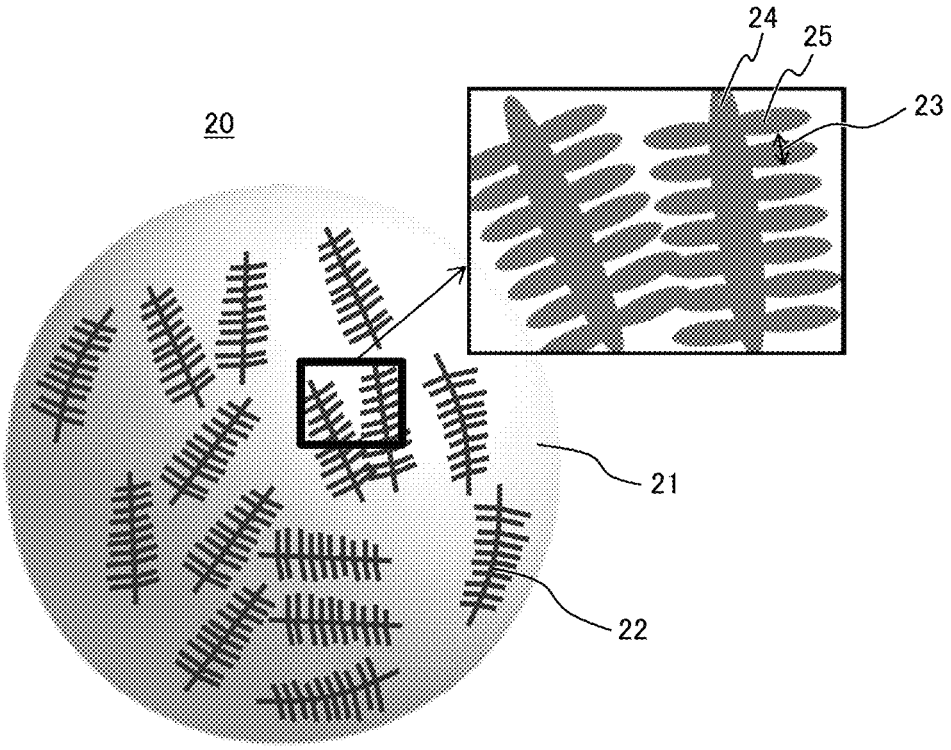
FIG. 1 is a view illustrating schematically a powdery surface of a Co based alloy powder of the present invention.

As described above, about a Co based alloy material, various researches and developments have been made about the strengthening thereof by the precipitation of a carbide phase. Examples of the carbide phase contributing to the precipitation strengthening include respective MC type carbide phases ("M" means transition metal element and "C" means carbide) of Ti, Zr, Nb, Ta, Hf and V, and a composite carbide phase of two or more of these metal elements.

A C component essential for being combined with each component of Ti, Zr, Nb, Ta, Hf and V to produce a carbide phase has a nature of being remarkably segregated, at time of melting and solidifying a Co based alloy, into a finally solidified region (such as dendrite boundaries and crystal grain boundaries) of the alloy. For this reason, in any conventional Co based alloy material, carbide phase grains thereof precipitate along dendrite boundaries and crystal grain boundaries of the matrix. For example, in an ordinal cast material of Co based alloy, the average interval between its dendrite boundaries, and the average crystal grain size of the material are each usually in the order of $10^1$ to $10^2$ μm, so that the average interval between grains of the carbide phase is also in the order of $10^1$ to $10^2$ μm. Moreover, even according to laser welding or any other process in which the solidifying speed of the alloy is relatively high, in the solidified regions, the average interval between the carbide phase grains is about 5 μm.

It is generally known that the degree of the precipitation strengthening of alloy is in disproportion with the average interval between precipitates therein. Thus, it is reported that the precipitation strengthening becomes effective in a case where the average interval between the precipitates is about 2 μm or less. However, according to the abovementioned conventional technique, the average interval between the precipitates does not reach the level described just above. Thus, the technique does not produce a sufficient advantageous effect of precipitation strengthening. In other words, in the prior art, it has been difficult that carbide phase grains contributing to alloy strengthening are finely dispersed and precipitated. This matter is a main reason why it has been said that Co based alloy material is insufficient in mechanical properties when compared with precipitation strengthened Ni based alloy material.

For reference, another carbide phase which can precipitate in Co based alloy is a Cr carbide phase. A Cr component is high in solid-solution performance into the Co based alloy matrix, so as not to be easily segregated therein. Thus, the Cr carbide phase can be dispersed and precipitated into crystal grains in the matrix. However, it is known that the Cr carbide phase is low in lattice-matching with matrix crystals of the Co based alloy, so as not to be very effective as a precipitation strengthening phase.

The inventors have conceived that if, in a Co based alloy material, carbide phase grains contributing to precipitation strengthening of the material can be dispersed and precipitated into matrix crystal grains, the Co based alloy material can be dramatically improved in mechanical properties. The inventors have also conceived that if this matter is combined with good corrosion and abrasion resistances which the Co based alloy material originally has, a heat resistant alloy material can be produced which surpasses precipitation strengthened Ni based alloy materials.

Thus, the inventors have made eager researches about an alloy composition and a producing method that each give such a Co based alloy material. As a result, the inventors have found out that carbide phase grains contributing to alloy strengthening can be dispersed and precipitated into matrix crystal grains of a Co based alloy material by optimizing the composition of the alloy. The present invention has been accomplished on the basis of this finding.

Hereinafter, embodiments of the present invention will be described with reference to the drawings. However, the present invention is never limited to the embodiment referred to herein, and may be improved by combining any one of the embodiments appropriately with a conventional technique, or on the basis of a conventional technique as far as the resultant does not depart from the technical conception of the invention.

[Chemical Composition of Co Based Alloy Powder]

Hereinafter, a description will be made about the chemical composition of the Co based alloy powder of the present invention.

C: 0.08 Mass % or More and 0.25 Mass % or Less

The C component is an important component for constituting one or more MC type carbide phases (one or more carbide phases of Ti, Zr, Nb, Ta, Hf and/or V, which may be referred to as one or more strengthening carbide phases), which become(s) one or more precipitation strengthened phases. The content by percentage of the C component is preferably 0.08 mass % or more and 0.25 mass % or less, more preferably 0.1 mass % or more and 0.2 mass % or less, and even more preferably 0.12 mass % or more and 0.18 mass % or less. If the content is less than 0.08 mass %, the precipitation amount of the C strengthening carbide phase is short so that the C component does not sufficiently give an advantageous effect of an improvement in mechanical properties of the alloy. By contrast, if the C content is more than 0.25 mass %, the alloy is excessively hardened so that a sintered body yielded by sintering the Co based alloy is lowered in ductility and toughness.

B: 0.1 Mass % or Less

The B component is a component contributing to an improvement of crystal boundaries in bonding performance (the so-called boundary strengthening). The B component is not an essential component. When the component is incorporated, the content by percentage thereof is preferably 0.1 mass % or less, and more preferably 0.005 mass % or more and 0.05 mass % or less. If the content is more than 0.1 mass %, at the time of the sintering of the powder or a heat treatment subsequent thereto the resultant Co based alloy is easily cracked or broken.

Cr: 10 Mass % or More and 30 Mass % or Less

The Cr component is a component contributing to an improvement in the corrosion resistance and oxidation resistance of the alloy. The content by percentage of the Cr component is preferably 10 mass % or more and 30 mass % or less, and more preferably 10 mass % or more and 25 mass % or less. When a corrosion resistant coating layer is separately applied to the outermost surface of a Co based alloy product, the content of the Cr component is even more preferably 10 mass % or more and 18 mass % or less. If the Cr content is less than 10 mass %, the powder is insufficient in corrosion resistance and oxidation resistance. By contrast, if the Cr content is more than 30 mass %, a brittle σ phase is produced or a Cr carbide phase is produced to lower the alloy in mechanical properties (toughness, ductility, and strength).

Ni: 30 Mass % or Less

The Ni component has properties similar to those of the Co component, and is lower in cost than Co. Thus, the Ni component is a component which can be incorporated in the form that the Co component is partially replaced by this component. The Ni component is not an essential component. When the Ni component is incorporated thereinto, the content by percentage thereof is preferably 30 mass % or less, more preferably 20 mass % or less, and even more preferably 5 mass % or more and 15 mass % or less. If the Ni content is more than 30 mass %, the Co based alloy is lowered in abrasion resistance and local stress resistance which are characteristics of this alloy. This would be caused by a difference in stacking fault energy between Co and Ni.

Fe: 5 Mass % or Less

The Fe component is far more inexpensive than Ni, and further has similar in natures to the Ni component. Thus, the Fe component is a component which can be incorporated in the form that the Ni component is partially replaced by this component. Specifically, the total content by percentage of Fe and Ni is preferably 30 mass % or less, more preferably 20 mass % or less, and even more preferably 5 mass % or more and 15 mass % or less. The Fe component is not an essential component. When the component is incorporated, the Fe content is preferably 5 mass % or less, and more preferably 3 mass % or less in the range of being lower than the Ni content. If the Fe content is more than 5 mass %, this content becomes a factor of lowering the corrosion resistance and the mechanical properties.

W and/or Mo: 5 Mass % or More and 12 Mass % or Less in Total

The W component and the Mo component are components contributing to the solution-strengthening of the matrix. The content by percentage of the W component and/or the Mo component is more preferably 5 mass % or more and 12 mass % or less, and more preferably 7 mass % or more and 10 mass % or less in total. If the total content of the W component and the Mo component is less than 5 mass %, the solution-strengthening of the matrix is insufficient. By contrast, if the total content of the W component and the Mo component is more than 12 mass %, a brittle σ phase is easily produced to lower the alloy in mechanical properties (toughness and ductility).

Re: 2 Mass % or Less

The Re component is a component contributing to improvements on not only the solution-strengthening of the matrix but also the corrosion resistance of the alloy. The Re component is not an essential component. When this component is incorporated, the Re content by percentage is preferably 2 mass % or less in the form that the W or Mo component is partially replaced by the Re component. The Re content is more preferably 0.5 mass % or more and 1.5 mass % or less. If the Re content is more than 2 mass %, the advantageous effects of the Re component are saturated and further this component gives a disadvantage of an increase in material costs.

One or more of Ti, Zr, Nb, Ta, Hf, and V: 0.5 mass % or more and 2 mass % or less in total The Ti, Zr, Nb, Ta, Hf, and V components are each a component important for constituting the strengthening carbide phase (MC type carbide phase). The content by percentage of one or more of the Ti, Zr, Nb, Ta, Hf and V components is preferably 0.5 mass % or more and 2 mass % or less, and more preferably 0.5 mass % or more and 1.8 mass % or less in total. If the total content is lower than 0.5 mass %, the precipitation amount of the strengthening carbide phase is short so that the advantageous effect of the improvement in the mechanical properties is not sufficiently obtained. By contrast, if the total content is more than 2 mass %, the following are caused: grains of the strengthening carbide phase become coarse; production of a brittle phase (for example, a σ phase) is promoted; or oxide phase grains, which do not contribute to the precipitation strengthening, are produced. Thus, the mechanical properties are lowered.

More specifically, when Ti is incorporated, the Ti content by percentage is preferably 0.01 mass % or more and 1 mass % or less, and more preferably 0.05 mass % or more and 0.8 mass % or less. When Zr is incorporated thereinto, the Zr content by percentage is preferably 0.05 mass % or more and 1.5 mass % or less, and more preferably 0.1 mass % or more and 1.2 mass % or less. When Nb is incorporated thereinto, the Nb content by percentage is preferably 0.02 mass % or more and 1 mass % or less, and more preferably 0.05 mass % or more and 0.8 mass % or less. When Ta is incorporated thereinto, the Ta content by percentage is preferably 0.05 mass % or more and 1.5 mass % or less, and more preferably 0.1 mass % or more and 1.2 mass % or less. When Hf is incorporated thereinto, the Hf content by percentage is preferably 0.01 mass % or more and 0.5 mass % or less, and more preferably 0.02 mass % or more and 0.1 mass % or less. When V is incorporated thereinto, the V content by percentage is preferably 0.01 mass % or more and 0.5 mass % or less, and more preferably 0.02 mass % or more and 0.1 mass % or less.

Si: 0.5 Mass % or Less

The Si component is a component taking charge of deoxidization to contribute to an improvement in the mechanical properties. The Si component is not an essential component. When this component is incorporated, the Si content by percentage is preferably 0.5 mass % or less, and more preferably 0.01 mass % or more and 0.3 mass % or less. If the Si content is more than 0.5 mass %, coarse grains of oxides (for example, $SiO_2$) are produced to become a factor of lowering the mechanical properties.

Mn: 0.5 Mass % or Less

The Mn component is a component taking charge of deoxidization and desulfurization to contribute to an improvement in the mechanical properties. The Mn component is not an essential component. When this component is incorporated, the Mn content by percentage is preferably 0.5 mass % or less, and more preferably 0.01 mass % or more and 0.3 mass % or less. If the Mn content is more than 0.5 mass %, coarse grains of sulfides (for example, MnS) are produced to become a factor of lowering the mechanical properties and the corrosion resistance.

N: 0.003 Mass % or More and 0.04 Mass % or Less, or 0.04 Mass % or More and 0.1 Mass % or Less The N component is varied in content by percentage in accordance with an atmosphere for gas atomizing when the Co based alloy powder is produced. When the gas atomizing is performed in the argon atmosphere, the N content percentage is lowered (N: 0.003 mass % or more and 0.04 mass % or less). When the gas atomizing is performed in a nitrogen atmosphere, the N content is raised (N: 0.04 mass % or more and 0.1 mass % or less).

The N component is a component contributing to stabilizing of the strengthening carbide phase. If the N content is less than 0.003 mass %, the advantageous effect of the N component is not sufficiently obtained. By contrast, if the N content is more than 0.1 mass %, coarse grains of nitrides (for example, a Cr nitride) are produced to become a factor of lowering the mechanical properties.

Balance: Co component+impurities

The Co component is a main component of the present alloy and is a component which is the largest in content by percentage. As described above, the Co based alloy material has an advantage of having corrosion resistance and abrasion resistance equivalent to or more than those of Ni based alloy material.

An Al component is one impurity of the present alloy, and is not a component that should be intentionally incorporated. However, when the Al content by percentage is 0.5 mass % or less, the component does not produce a large bad effect onto mechanical properties of the resultant Co based alloy product. Thus, the incorporation of Al is permissible. If the Al content is more than 0.5 mass %, coarse grains of oxides or nitrides (for example, $Al_2O_3$ and AlN) are produced to become a factor of lowering the mechanical properties.

An O component is also one impurity of the present alloy, and is not a component that should be intentionally incorporated. However, when the O content by percentage is 0.04 mass % or less, the component does not produce a large bad effect onto mechanical properties of the resultant Co based alloy product. Thus, the incorporation of O is permissible. If the O content is more than 0.04 mass %, coarse grains of various oxides (for example, Ti oxides, Zr oxides, Al oxides, Fe oxides, and Si oxides) are produced to become a factor of lowering the mechanical properties.

[Methods for Producing Co Based Alloy Powder]

Figure 2:
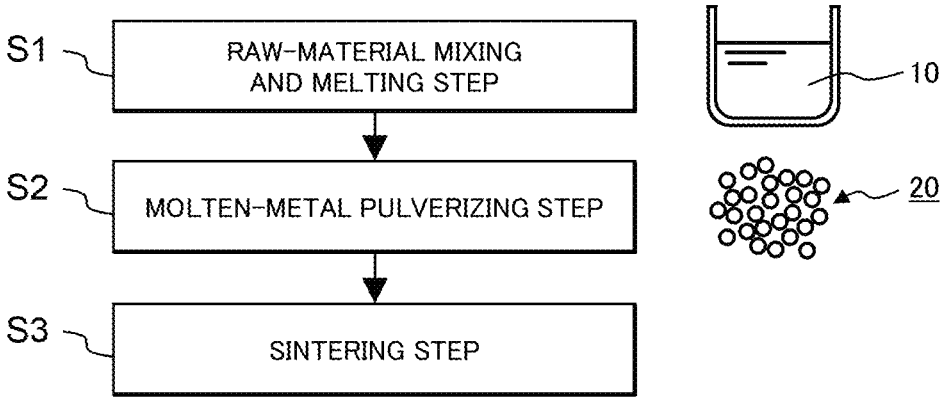
FIG. 2 is a flowchart showing an example of a process of a method of the present invention for producing a Co based alloy powder.

FIG. 2 is a flowchart showing an example of steps of a method of the present invention for producing a Co based alloy powder and Co based alloy sintered body. As shown in FIG. 2, a raw-material mixing and melting step (step 1: S1) is initially performed in which raw materials of a Co based alloy powder of the present invention are mixed with each other to give a composition of the Co based alloy powder that has been described above, and then molten to produce a molten metal 10. The method for the melting is not particularly limited, and a conventional method for highly heat-resistant alloy is preferably usable (for example, an induction melting method, electron beam melting method, or plasma arc melting method).

In order to decrease the content by percentage of impurity components further in the resultant alloy (or heighten the alloy in purity), it is preferred in the raw-material mixing and melting step S1 to solidify the molten metal 10 once after the production of this molten metal 10 to form a raw material alloy lump, and then remelt the raw material alloy lump to produce a purified molten metal. As far as the purity of the alloy is heightened, the method for the remelting is not particularly limited. For example, a vacuum arc remelting (VAR) method is preferably usable.

Next, a molten-metal-pulverizing step (step 2: S2) is performed in which from the molten melt 10 (or the purified molten metal), a quenched and solidified alloy powder 20 is produced. The Co based alloy powder of the present invention is produced by the quenching and solidifying in which the cooling speed of the powder is high. Thus, as illustrated in FIG. 1, segregated cells can be obtained which improve the strength of the resultant Co based alloy product. The average size of the segregated cells becomes smaller as the cooling speed is higher.

As far as the powder 20 can obtain a highly pure and homogeneous composition, the method for the melting-pulverizing is not particularly limited, and a conventional alloy-pulverizing method is preferably usable (for example, an atomizing method (a gas atomizing method or plasma atomizing method, a water atomizing method)).

[Microstructure of Co Based Alloy Powder]

FIG. 1 is a view illustrating schematically a powdery surface of a Co based alloy powder of the present invention. As illustrated in FIG. 1, the Co based alloy powder of the present invention, which is a powder 20, is a polycrystal made of a powder 21 having an average powder particle size of 5 μm or more and 150 μm or less, and segregated cells 22 are formed in the surface and the inside of the powder 21. The segregated cells 22 are varied in shape by the cooling speed of the Co based alloy powder in a step of producing this powder (pulverizing step), this step being to be described later. When the cooling speed is relatively high, spherical segregated cells are produced. When the cooling speed is relatively low, dendrite-form (tree branch form) segregated cells are produced. In FIG. 1 is illustrated an example in which the segregated cells are in a dendrite form. It is conceivable that after the Co based alloy powder 20 is sintered, a carbide is precipitated along the segregated cells.

The average size of the segregated cells is preferably 0.15 μm or more and 4 μm or less. The dendrite microstructures illustrated in FIG. 1 each have a primary branch 24 and secondary branches 25 extending from the primary branch 24. The average size of the segregated cells in the dendrite microstructures is the average width (arm interval) 23 (portion shown by an arrow in FIG. 1) of the secondary branches 25.

Note that the "average size of the segregated cells" is a diameter in the case that the segregated cell has spherical shape. The "average size of the segregated cells" is defined as the average value of the respective sizes of segregated cells in a predetermined region of an observed image of a powder through an SEM (scanning electron microscope) or the like.

[Particle Size of Co Based Alloy Powder]

A particle size of the Co based alloy powder is preferably from 5 to 85 μm, more preferably from 10 to 85 μm and most preferably from 5 to 25 μm.

Preferred compositions of the Co based alloy powder of the present invention are shown in Table 1 described below.

(Respective Productions of Cast Alloy Product in which IA-2 Powder was Used and Cast Alloy Product in which CA-5 Powder was Used)

An alloy powder of each of the above-described IA-2 and CA-5 which has a particle size L was used to form a cast body (a diameter of 8 mm×a height of 10 mm) by precision casting, and subjected to the same solution heat treatment and aging heat treatment as described above to produce a cast alloy product (cast body) in which either of the IA-2 powder and the CA-5 powder was used.

(Microstructure Observation and Mechanical Property Measurement)

From each of the sintered bodies and cast bodies produced as described above, test pieces for microstructure observation and mechanical property measurements were collected, and then subjected to microstructure observation and mechanical property measurements.

The microstructure observation was performed through an SEM. Each of the obtained SEM observed images was subjected to image analysis using an image processing software (Public Domain Software developed by Image J, National Institutes of Health (NIH)) to measure the average size of segregated cells therein, the average interval between micro segregations therein, and the average distance between grains of carbide phase grains therein.

TABLE 1

Chemical composition of each of alloy powders IA-1 to IA-7 and CA-1 to CA-5

| Alloy powder | Chemical composition (mass %) | | | | | | | | | | | | | | | | | | |
|---|---|---|---|---|---|---|---|---|---|---|---|---|---|---|---|---|---|---|---|
| | C | B | Cr | Ni | Fe | W | Ti | Zr | Hf | V | Nb | Ta | Si | Mn | N | Co | Al | O | Ti + Zr + Hf + V + Nb + Ta |
| IA-1 | 0.16 | 0.009 | 24.7 | 9.3 | 0.01 | 7.5 | 0.16 | 0.45 | — | — | 0.20 | 0.15 | 0.01 | 0.01 | 0.005 | Bal. | 0.01 | 0.005 | 0.96 |
| IA-2 | 0.25 | 0.011 | 26.5 | 10.5 | 0.90 | 7.4 | 0.30 | 0.60 | — | — | 0.15 | 0.40 | 0.30 | 0.20 | 0.030 | Bal. | 0.05 | 0.020 | 1.45 |
| IA-3 | 0.08 | 0.009 | 30.0 | — | — | 5.0 | — | 0.35 | — | — | 0.16 | — | 0.05 | 0.01 | 0.005 | Bal. | — | 0.005 | 0.51 |
| IA-4 | 0.10 | 0.010 | 25.0 | 8.0 | 0.02 | 7.5 | 0.25 | 0.05 | — | — | 0.09 | 0.30 | 0.01 | 0.02 | 0.010 | Bal. | — | 0.010 | 0.69 |
| IA-5 | 0.18 | 0.009 | 24.9 | 9.2 | 0.01 | 7.6 | 0.17 | 0.45 | 0.02 | 0.04 | 0.21 | 0.16 | 0.01 | 0.01 | 0.015 | Bal. | 0.01 | 0.010 | 1.05 |
| IA-6 | 0.24 | 0.011 | 25.5 | 10.3 | 0.90 | 7.4 | 0.20 | 0.60 | 0.05 | 0.02 | 0.15 | 0.40 | 0.30 | 0.20 | 0.08 | Bal. | 0.06 | 0.025 | 1.42 |
| IA-7 | 0.08 | 0.009 | 29.5 | — | — | 6.0 | 0.10 | 0.15 | 0.01 | 0.04 | — | 0.30 | 0.15 | 0.10 | 0.005 | Bal. | — | 0.005 | 0.60 |
| CA-1 | 0.35 | 0.009 | 32.5 | 9.5 | 0.01 | 7.3 | 0.15 | 0.40 | — | — | 0.05 | 0.50 | 0.01 | 0.01 | 0.005 | Bal. | 0.01 | 0.005 | 1.10 |
| CA-2 | 0.35 | 0.009 | 30.0 | 40.0 | 0.01 | 7.3 | 0.90 | 0.40 | — | — | 1.0 | 1.0 | 0.01 | 0.01 | 0.005 | Bal. | 2.20 | 0.005 | 3.30 |
| CA-3 | 0.40 | 0.010 | 29.0 | 10.0 | 0.20 | 7.5 | 0.20 | 0.10 | — | — | 0.10 | — | 0.10 | 0.02 | 0.001 | Bal. | — | 0.015 | 0.40 |
| CA-4 | 0.25 | 0.010 | 29.0 | 10.0 | 0.10 | 7.5 | — | — | — | — | — | — | — | 0.01 | 00.10 | Bal. | — | 0.010 | 0 |
| CA-5 | 0.11 | 0.002 | 22.0 | 23.0 | 0.01 | 14.0 | 0.01 | 0.01 | — | — | — | — | 0.50 | 0.003 | 0.006 | Bal. | 0.01 | 0.008 | 0.02 |

—: The symbol shows that the element concerned was not intentionally incorporated, or was not detected.

Bal.: The symbol shows the balance including impurities other than Al and O

[Method for Manufacturing Process of Co Based Alloy Sintered Body]

A sintering step (step 3: S3) is performed in which the quenched and solidified alloy powder 20 is sintered as shown in the FIG. 2. In this way, the Co based alloy sintered body of the present invention can be gained. The method for the sintering is not particularly limited. For example, a hot isostatic pressing is usable.

(Respective Productions of Sintered Body in which IA-2 Powder is Used and Sintered Body in which CA-5 Powder is Used)

An alloy powder of each of the IA-2 and CA-5 shown in the table 1 which had a purity S was used to form a shaped body (a diameter of 8 mm×a height of 10 mm) by HIP. Sintering conditions for the HIP were adjusted to a temperature of 1150° C., a pressure of 150 MPa, and a period of one hour. Thereafter, the shaped body was subjected to heat treatment at 980° C. for four hours to produce a sintered body in which either of the IA-2 powder and the CA-5 powder was used.

Regarding the mechanical property measurements, one of the test pieces was subjected to a tensile test at 800° C. to measure the 0.2% proof stress.

Figure 5:
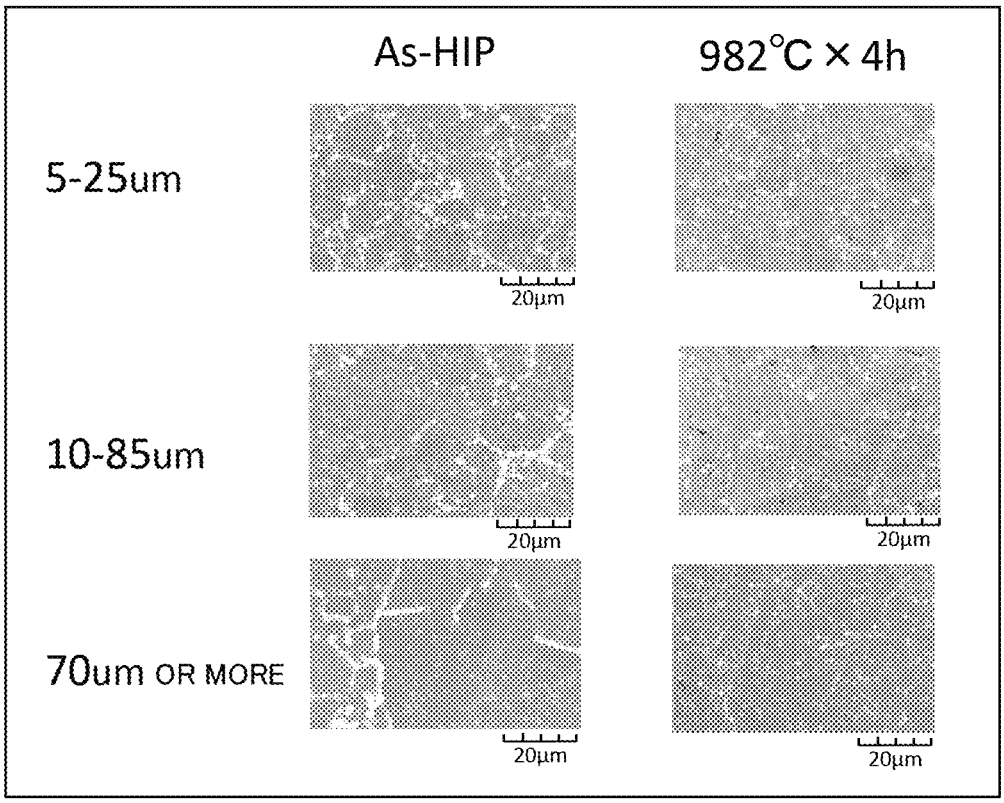
FIG. 5 is respective SEM observed photographs of Co based alloy sintered bodies of the present invention.

FIG. 5 is respective SEM observed photographs of Co based alloy sintered bodies of the present invention. FIG. 5 shows photographs of the Co based alloy powder having a three types of particle size (5 to 25 μm, 10 to 85 μm and 70 μm or more) heated (982° C., 4 hours) immediately after HIP or after HIP. It can be seen that a microstructure of the sintered body is maintained before and after the heat treatment. Further, the each of the Co based alloy sintered bodies has a microstructure which strengthening carbide phase particles precipitate. These strengthening carbide phase particles are considered that precipitating along the segregated cells by the sintering.

Table 2 shows the 0.2% proof stress and the tensile strength of each of the Co based alloy sintered bodies of the present invention, and Table 3 shows the average precipitate interval L and the tensile strength of each of the Co based alloy sintered bodies. Table 2 also shows results of the cast material. As shown in Table 2, each of the particle sizes results in the attainment of a 0.2% proof stress and a tensile strength which are higher than those of the cast material. Moreover, it is understood from Table 3 that an average precipitate interval L of 1 to 1.49 μm results in the attainment of an especially high tensile strength (460 MPa or more).

TABLE 2

| | Powder particle size (μm) | Test temperature (° C.) | 0.2% Proof stress (MPa) | Tensile strength (MPa) |
|---|---|---|---|---|
| HIP | 5-25 | 800 | 371 | 489 |
| material | 10-70 | 800 | 326 | 461 |
| | >70 | 800 | 306 | 453 |
| Cast material | — | 800 | 200 | 300 |

TABLE 3

| Powder particle size (μm) | Average precipitate interval L (μm) | Tensile strength (MPa) |
|---|---|---|
| 5-25 | 1 | 489 |
| 10-70 | 1.49 | 461 |
| >70 | 3.72 | 453 |

Figure 6:
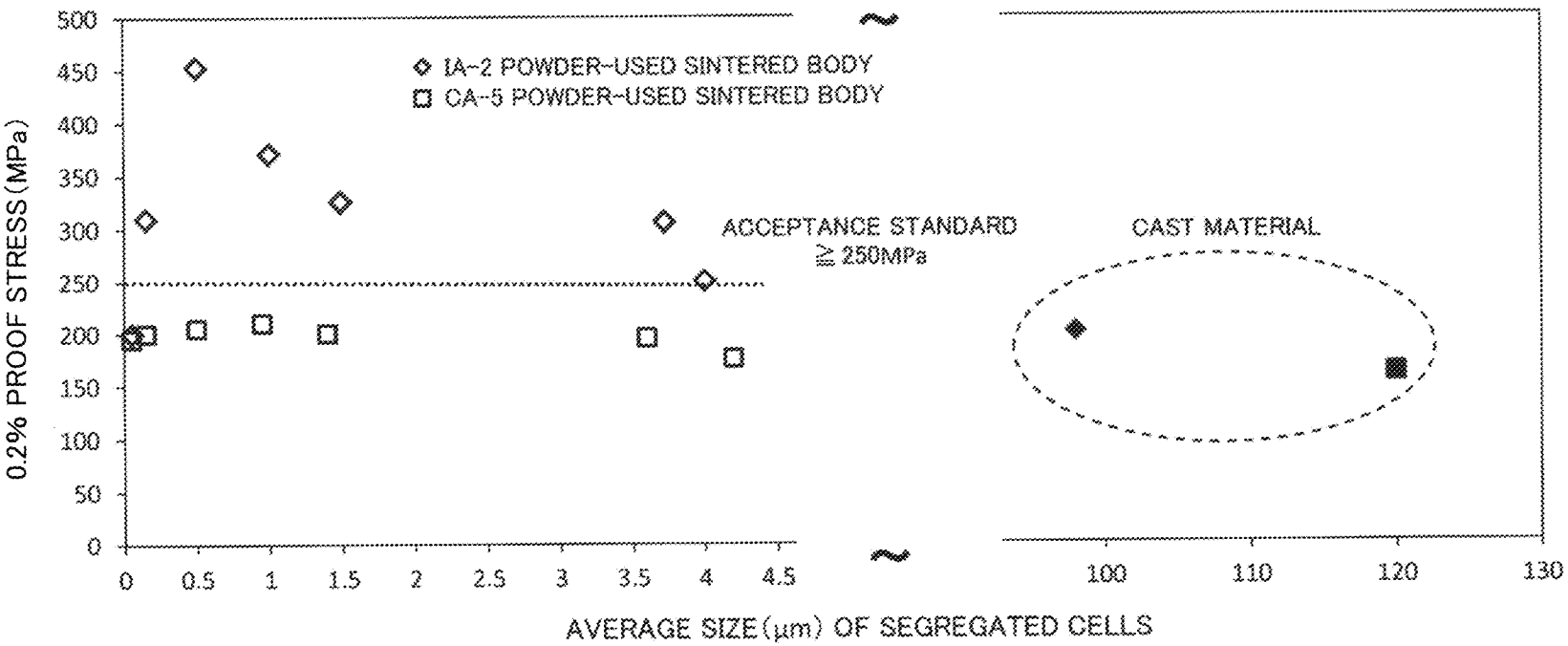
FIG. 6 is a graph showing a relationship between the average size of segregated cells in each of Co based alloy sintered bodies and a cast body, and the 0.2% proof stress thereof at 800° C.

FIG. 6 is a graph showing a relationship between the average size of segregated cells in each of Co based alloy sintered bodies and a cast body, and the 0.2% proof stress thereof at 800° C. In FIG. 6, data about the cast body is also shown for comparison. Moreover, in FIG. 6, the average interval between micro segregates is substituted for the average size of segregated cells. In FIG. 6, "IA-2" and "CA-5" are Co based alloy powder having the composition shown in the Table 1.

As illustrated in FIG. 6, the Co based alloy sintered body produced using the CA-5 powder showed substantially constant 0.2% proof stress without being affected by the average size of the segregated cells. By contrast, the Co based alloy sintered body produced using the IA-2 powder was largely varied in 0.2% proof stress in accordance with the average size of the segregated cells.

The CA-5 powder is excessively small in total content by percentage of "Ti+Zr+Nb+Ta+Hf+V" (the powder hardly contains these elements). Thus, the microstructure-observed result of the sintered body in which the CA-5 powder is used has demonstrated that the sintered body has a microstructure in which no strengthening carbide phase precipitates but Cr carbide grains precipitate. From this result, it has been verified that the Cr carbide grains are not very effective as precipitation strengthening grains. By contrast, the sintered body in which the IA-2 powder was used has had a microstructure in which strengthening carbide grains precipitate. For this reason, it appears that the 0.2% proof stress thereof has been largely varied in accordance with the average size of the segregated cells (the average grain distance between the carbide phase grains, this distance being determined as a result of the average size).

Considering requirement properties for turbine high-temperature members which are targets of the present invention, the 0.2% proof stress of alloy at 800° C. needs to be 250 MPa or more. Thus, when a proof stress more than 250 MPa is judged to be "acceptable" and a proof stress less than 250 MPa is judged to be "unacceptable", it has been verified that allowable mechanical properties are gained in such a range that the average size of segregated cells (the average grain distance between the carbide phase grains, this distance being determined as a result of the average size) is in the range of 0.15 to 4 μm. In other words, one reason why a conventional carbide-phase-precipitated Co based alloy material gains no sufficient mechanical properties would be that the average grain distance between strengthening carbide phase grains cannot be controlled into a desired range.

If the average interval between the segregated cells is 0.1 μm or less, carbide on the segregated cells is aggregated by heat treatment so that the average grain distance between the carbide phase grains is unfavorably enlarged. Thus, the 0.2% proof stress would be lowered. Moreover, if the average interval is more than 4 μm or more, an effect onto the 0.2% proof stress becomes small.

From the abovementioned results, the average size of segregated cells constituting the Co based alloy powder of the present invention would also be preferably from 0.15 to 4 μm. The average size of the segregated cells is more preferably from 0.15 to 2 μm, and even more preferably from 0.15 to 1.5 μm. Also in a Co based alloy sintered body obtained by sintering the Co based alloy powder of the present invention, its segregated cells would have an average size equivalent to that of the segregated cells in the Co based alloy powder by an appropriate sintering of the powder. A Co based alloy powder sintered body would be gained in which carbide grains precipitate at an interval of 0.15 to 4 μm.

In addition, the raw materials of the Co based alloy powder preferably contain the above-defined Co based alloy powder in a proportion of 75 mass % or more, and more preferably 90 mass % or more.

[Product in which Co Based Alloy Sintered Body is Used]

Figure 3:
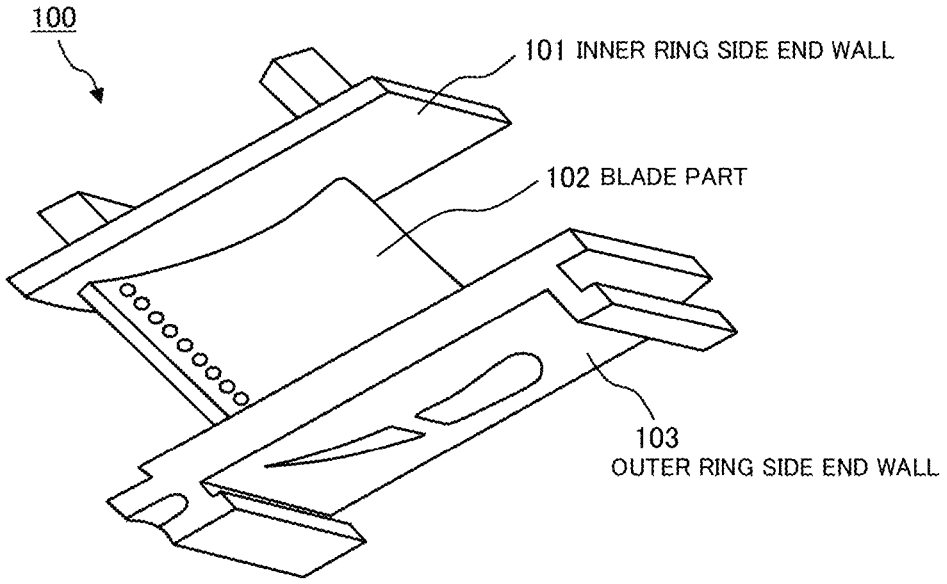
FIG. 3 is a schematic perspective view illustrating an example of a product in which a Co based alloy sintered body of the present invention is used, the product being a turbine static blade as a turbine high-temperature member.

FIG. 3 is a schematic perspective view illustrating an example of the Co based alloy product of the present invention, the product being a turbine static blade as a turbine high-temperature member. As illustrated in FIG. 3, the turbine static blade, which is a blade 100, is roughly composed of an inner ring end wall 101, a blade part 102, and an outer ring end wall 103. Inside the blade part, a cooling structure is often formed. In the case of, for example, a 30-MW-class gas turbine for power generation, the length of a blade part of its turbine static blade (the distance between both end walls thereof) is about 170 mm.

Figure 4:
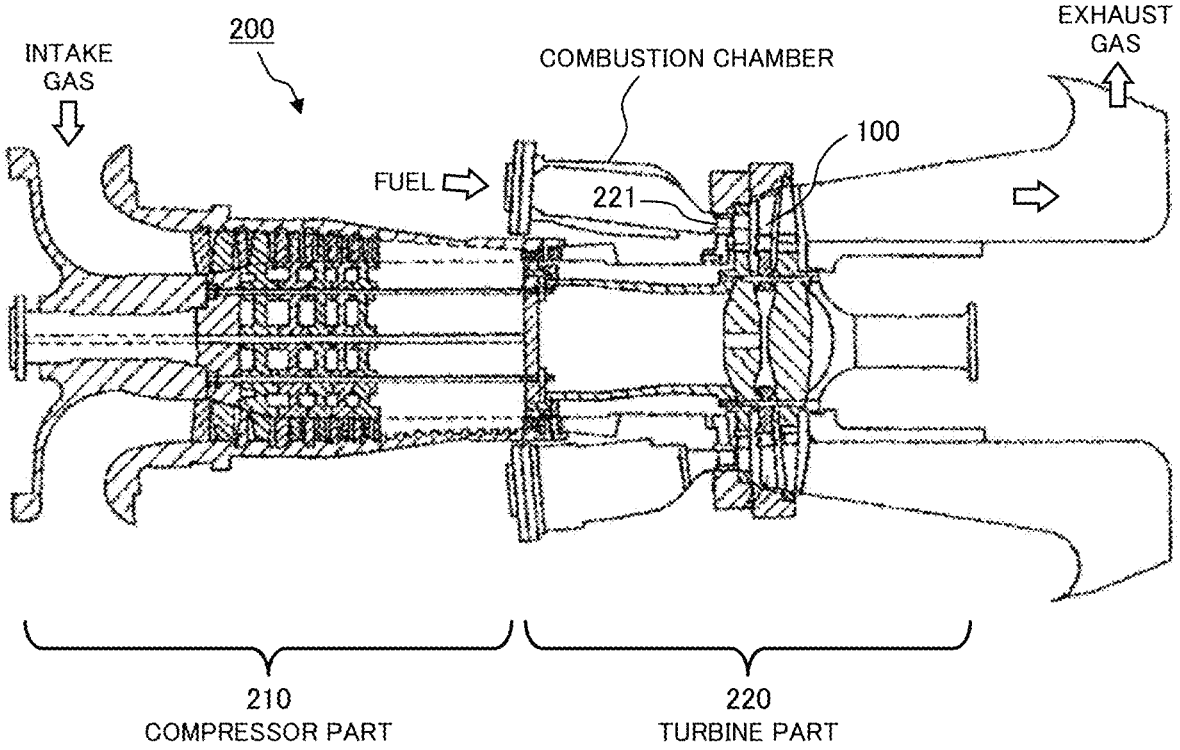
FIG. 4 is a schematic sectional view illustrating an example of a gas turbine equipped with a product in which a Co based alloy sintered body of the present invention is used.

FIG. 4 is a schematic sectional view illustrating an example of a gas turbine equipped with a Co based alloy product according to the present invention. As illustrated in FIG. 4, a gas turbine 200 is roughly composed of a compressor part 210 for compressing an intake gas and a turbine part 220 for blowing a fuel gas of a fuel onto a turbine blade to give rotary power. The turbine high-temperature member of the present invention is favorably usable as a turbine nozzle 221 or the turbine static blade 100 inside the turbine part 220. Note that the turbine high-temperature member of the present invention is not limited to any gas turbine article, and may be used for any other turbine article (for example, any steam turbine article).

The abovementioned embodiments or experiments have been described for the aid of the understanding of the present invention. Thus, the present invention is not limited only to the described specific structures. For example, the structure of any one of the embodiments may be partially replaced by a constitution according to common knowledge of those skilled in the art. Moreover, a constitution according to common knowledge of those skilled in the art may be added to the structure of any one of the embodiments. In other words, in the present invention, the structure of any one of the embodiments or experiments in the present specification may be partially subjected to deletion, replacement by a different constitution and/or addition of a different constitution as far as the resultant does not depart from the technical conception of the present invention.

REFERENCE SIGNS LIST

20: Co based alloy powder, 21: crystal grain of Co based alloy powder, 22: dendrite microstructure, 100: turbine static blade, 101: inner side end wall, 102: blade part, 103: outer side end wall, 200: gas turbine, 210: compressor part, 220: turbine part, 221: turbine nozzle.

The invention claimed is:

1. A cobalt-based alloy powder, comprising:
0.08 mass % or more and 0.25 mass % or less of carbon;
0.1 mass % or less of boron;
10 mass % or more and 30 mass % or less of chromium;
5 mass % or less of iron; and
30 mass % or less of nickel,
comprising the iron and the nickel to be in a total amount of 30 mass % or less,
comprising at least one selected from the group of tungsten and molybdenum to be in a total amount of 5 mass % or more and 12 mass % or less,
comprising at least one selected from the group of titanium, zirconium, niobium, tantalum, hafnium, and vanadium to be in a total amount of 0.5 mass % or more and 2 mass % or less, comprising:
0.5 mass % or less of silicon;
0.5 mass % or less of manganese; and
0.003 mass % or more and 0.04 mass % or less of nitrogen as an essential element; and comprising cobalt and impurities as the balance of the powder, and
the impurities include more than 0 mass % and 0.5 mass % or less of aluminum and 0.0005 mass % or more and 0.04 mass % or less of oxygen,
crystal grains comprised in the cobalt-based alloy powder having segregated cells, and the segregated cells having an average size of 0.15 μm or more and 4 μm or less.

2. A cobalt-based alloy powder, comprising:
0.08 mass % or more and 0.25 mass % or less of carbon;
0.1 mass % or less of boron;
10 mass % or more and 30 mass % or less of chromium;
5 mass % or less of iron; and
30 mass % or less of nickel,
comprising the iron and the nickel to be in a total amount of 30 mass % or less,
comprising at least one selected from the group of tungsten and molybdenum to be in a total amount of 5 mass % or more and 12 mass % or less,
comprising at least one selected from the group of titanium, zirconium, niobium, tantalum, hafnium, and vanadium to be in a total amount of 0.5 mass % or more and 2 mass % or less,
comprising:
0.5 mass % or less of silicon;
0.5 mass % or less of manganese; and
more than 0.04 mass % and 0.1 mass % or less of nitrogen as an essential element, and comprising cobalt and impurities as the balance of the powder, and the impurities include more than 0 mass% and 0.5 mass % or less of aluminum and 0.005 mass % or more and 0.04 mass % or less of oxygen,
crystal grains comprised in the cobalt-based alloy powder having segregated cells, and the segregated cells having an average size of 0.15 μm or more and 4 μm or less.

3. A cobalt-based alloy powder, comprising:
0.08 mass % or more and 0.25 mass % or less of carbon;
0.1 mass % or less of boron;
10 mass % or more and 30 mass % or less of chromium;
5 mass % or less of iron; and
30 mass % or less of nickel,
comprising the iron and the nickel to be in a total amount of 30 mass % or less,
comprising at least one selected from the group of tungsten and molybdenum to be in a total amount of 5 mass % or more and 12 mass % or less,
comprising at least one selected from the group of titanium, zirconium, niobium, tantalum, hafnium, and vanadium to be in a total amount of 0.5 mass % or more and 2 mass % or less,
comprising:
0.5 mass % or less of silicon;
0.5 mass % or less of manganese; and
more than 0.04 mass % and 0.1 mass % or less of nitrogen as an essential element, and comprising cobalt and impurities as the balance of the powder, and
the impurities include more than 0 mass % and 0.5 mass % or less of aluminum and 0.005 mass % or more and 0.04 mass % or less of oxygen,
the cobalt-based alloy powder having a grain size of 5 μm or more and 85 μm or less.

4. The cobalt-based alloy powder according to claim 1, having a particle size of 5 μm or more and 85 μm or less.

5. The cobalt-based alloy powder according to claim 1, having a particle size of 5 to 25 μm.

6. The cobalt-based alloy powder according to claim 1, having a particle size of 10 to 85 μm.

7. The cobalt-based alloy powder according to claim 1,
wherein when the powder comprises the titanium, the titanium is in an amount of 0.01 mass % or more and 1 mass % or less,
when the powder comprises the zirconium, the zirconium is in an amount of 0.05 mass % or more and 1.5 mass % or less,
when the powder comprises the niobium, the niobium is in an amount of 0.02 mass % or more and 1 mass % or less, and
when the powder comprises the tantalum, the tantalum is in an amount of 0.05 mass % or more and 1.5 mass % or less,
when the powder comprises the hafnium, the hafnium is in an amount of 0.01 mass % or more and 0.5 mass % or less,
when the powder comprises the vanadium, the vanadium is in an amount of 0.01 mass % or more and 0.5 mass % or less.

8. The cobalt-based alloy powder according to claim 2, having a particle size of 5 μm or more and 85 μm or less.

9. The cobalt-based alloy powder according to claim 2, having a particle size of 5 to 25 μm.

10. The cobalt-based alloy powder according to claim 2, having a particle size of 10 to 85 μm.

11. The cobalt-based alloy powder according to claim 2,
wherein when the powder comprises the titanium, the titanium is in an amount of 0.01 mass % or more and 1 mass % or less, when the powder comprises the zirconium, the zirconium is in an amount of 0.05 mass % or more and 1.5 mass % or less, when the powder comprises the niobium, the niobium is in an amount of 0.02 mass % or more and 1 mass % or less, and when the powder comprises the tantalum, the tantalum is in an amount of 0.05 mass % or more and 1.5 mass % or less, when the powder comprises the hafnium, the hafnium is in an amount of 0.01 mass % or more and 0.5 mass % or less, when the powder comprises the vanadium, the vanadium is in an amount of 0.01 mass % or more and 0.5 mass % or less.

12. The cobalt-based alloy powder according to claim 3, having a particle size of 5 to 25 μm.

13. The cobalt-based alloy powder according to claim 3, having a particle size of 10 to 85 μm.

14. The cobalt-based alloy powder according to claim 3, wherein when the powder comprises the titanium, the titanium is in an amount of 0.01 mass % or more and 1 mass % or less, when the powder comprises the zirconium, the zirconium is in an amount of 0.05 mass % or more and 1.5 mass % or less, when the powder comprises the niobium, the niobium is in an amount of 0.02 mass % or more and 1 mass % or less, and when the powder comprises the tantalum, the tantalum is in an amount of 0.05 mass % or more and 1.5 mass % or less, when the powder comprises the hafnium, the hafnium is in an amount of 0.01 mass % or more and 0.5 mass % or less, when the powder comprises the vanadium, the vanadium is in an amount of 0.01 mass % or more and 0.5 mass % or less.

* * * * *